US008736198B2

(12) United States Patent
Haruna et al.

(10) Patent No.: US 8,736,198 B2
(45) Date of Patent: May 27, 2014

(54) CIRCULAR ACCELERATOR AND ITS OPERATION METHOD

(75) Inventors: Nobuyuki Haruna, Chiyoda-ku (JP); Katsuhisa Yoshida, Chiyoda-ku (JP); Masahiro Ikeda, Chiyoda-ku (JP); Kengo Sugahara, Chiyoda-ku (JP); Hirofumi Tanaka, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 7 days.

(21) Appl. No.: 13/306,578

(22) Filed: Nov. 29, 2011

(65) Prior Publication Data

US 2012/0274242 A1 Nov. 1, 2012

(30) Foreign Application Priority Data

Apr. 28, 2011 (JP) ..... 2011-100987

(51) Int. Cl.
*H05H 11/00* (2006.01)
*H01J 23/00* (2006.01)

(52) U.S. Cl.
USPC ..... 315/504; 315/500; 315/505; 315/507; 376/100; 250/505.1; 250/492.3; 250/251

(58) Field of Classification Search
USPC ..... 315/507, 500, 504, 505
See application file for complete search history.

(56) References Cited

U.S. PATENT DOCUMENTS 5,363,008 A 11/1994 Hiramoto et al.
5,783,914 A * 7/1998 Hiramoto et al. ..... 315/504
6,472,834 B2 * 10/2002 Hiramoto et al. ..... 315/501

FOREIGN PATENT DOCUMENTS

JP 5-198397 A 8/1993
JP 2003-086399 A 3/2003

OTHER PUBLICATIONS

Walter, et al., "Beam Extraction Concepts and Design for the University of Maryland Electron Ring (UMER)", Proceedings of PAC07, Albuquerque, New Mexico, USA, pp. 1754-1756.*
Saito et al., RF Accelerating System for a Compact Ion Synchrotron, 2001, Proceedings of the 2001 Particle Accelerator Conference, Chicago, pp. 966-968.*
Fong et al., New Technologies in the Design of RF Controls for Accelerators, 2007, Cyclotrons and their Applications 2007, Eighteenth International Conference, pp. 449-454.*
Birk et al., "The RF Control System of the NAL Accelerator", 1971, IEEE, pp. 427-431.*
Walter, et al., "Beam Extraction Concepts and Design for the University of Maryland Electron Ring (UMER)", Proceedings of PAC07, Albuquerque, New Mexico, USA, 2007, pp. 1754-1756.*

* cited by examiner

*Primary Examiner* — Alexander H Taningco
*Assistant Examiner* — David Lotter
(74) *Attorney, Agent, or Firm* — Buchanan Ingersoll & Rooney PC

(57) ABSTRACT

A circular accelerator comprises a target current value memory which stores a target current value of a beam current of charged particle which is extracted from an extracting device; and a frequency determination part in which a frequency change ratio is obtained by performing a feedback control based on an error signal between a detection signal of a beam current detector and a target current value which is stored in a target current value memory, and determines a subsequent frequency from the obtained frequency change ratio and a current frequency, wherein the subsequent frequency which is determined by the frequency determination part is stored in a frequency memory and a radio-frequency generator generates the subsequent radio-frequency of frequency which is determined.

14 Claims, 13 Drawing Sheets

CIRCULAR ACCELERATOR AND ITS OPERATION METHOD

BACKGROUND OF THE INVENTION

1. Field of the Invention

This invention relates to a circular accelerator in which charged particles are accelerated by a radio-frequency voltage and from which the accelerated charged particles are extracted, for being used as a particle beam therapy system.

2. Description of the Related Art

In circular accelerators such as synchrotron, charged particles are circulated and accelerated, then, the charged particles which are accelerated to high energy are extracted from a circulating orbit, and the charged particles (also referred as a charged particle beam or a particle beam) are transported by a beam transportation system. The obtained charged particle beam is utilized in a physical experiment where a desired object is irradiated or is utilized as medical use such as cancer therapy. A synchrotron comprises a vacuum duct for circulating a charged particle beam for a long time; a group of magnets which generate a dipole magnetic field or a quadruple magnetic field for controlling a circulating orbit or the size of a charged particle beam; a radio-frequency cavity, which accelerates a beam by a radio-frequency voltage (also referred as accelerating voltage) which is synchronized with a circulating period; a radio-frequency generator which controls a radio-frequency voltage to be applied to the radio-frequency cavity; an injector which introduces charged particles to a vacuum duct; and an extracting device which extracts a charged particle beam from a circular accelerator. Among the above-mentioned constituent parts, the radio-frequency generator comprises a radio-frequency source which generates an accelerating voltage; a radio-frequency control device which controls a frequency of the radio-frequency and a voltage; and an amplifier which amplifies the generated radio-frequency.

A radio-frequency generator applies an accelerating voltage to a radio-frequency cavity, and an incident beam having uniform distribution in time forms a bunched particle beam on a stable acceleration region. While acceleration of a beam, a frequency of an accelerating voltage to be applied to a radio-frequency cavity is increased. In a synchrotron which is a kind of circular accelerator (a circular accelerator includes a cyclotron whose circulating radius becomes larger as the beam is accelerated, in addition to a synchrotron whose circulating radius is constant), in order to make a circulating radius of a beam constant, corresponding to a dipole magnetic field intensity of a bending magnet for forming a circulating orbit of charged particles, a radio-frequency generator controls an accelerating voltage frequency. When a beam is accelerated to the intended energy, at the final stage, an orbit of the beam is bent by an extracting magnet and the beam is extracted from the circular accelerator.

In general, charged particles in a circular accelerator circulate while betatron oscillation is performed centering on a design orbit. On this occasion, the stability limit, called as the separatrix, exists. Charged particles within the stability limit, that is, the charged particles in a stable region circulate stably; however, charged particles which are beyond the stable region have the property such that the amplitude of oscillation is increased so as to be diverged. By utilizing this property, in order to extract charged particles, in conventional circular accelerators, by using a quadruple magnet, the tune which indicates betatron oscillation frequency per round of an accelerator (betatron number) is made close to be integer±⅓ and third order resonance is excited by using a sextupole magnet.

In extracting a particle beam, for example, a method, that is, the center momentum of charged particle beams as a group of charged particles which circulate is displaced by changing a frequency of a radio-frequency voltage to be applied to a radio-frequency cavity, the stable region of a betatron oscillation is narrowed so as to extract charged particles, is proposed (for example, JP2003-086399A). According to this method, as a beam is extracted corresponding to the amount of displacement of momentum, the beam is extracted while gradually changing a frequency of a radio-frequency voltage of a radio-frequency cavity.

Further, a method, in which electrodes which generate a radio-frequency voltage are provided in a circular accelerator in addition to a radio-frequency cavity, an amplitude of betatron oscillation is made increased by an electric field which is generated between the electrodes, without displacing the center momentum and with constant separatrix (the boundary between a stable region and a resonance region of betatron oscillation), so as to extract a charged particle beam by expelling a beam from a stable region to a resonance region is proposed (RF knockout method, JP5-198397A). According to this method, as the center momentum is not displaced, ideally, circulating frequency (center frequency) of a particle having the center momentum is constant; a radio-frequency signal to be applied to the electrode includes a frequency component which is synchronized with betatron oscillation. On this occasion, by considering such that in a precise sense, the tune of a particle has the continuous distribution, more effective extraction can be performed by widening the frequency band.

Recently, in a particle beam cancer therapy in which a circular accelerator is utilized, scanning irradiation method, in which a therapy aid (for example, bolus and collimator) for each patient is not necessary and a cancer site can be irradiated with high accuracy, is required. In a scanning irradiation, in general, beams are scanned in two dimensions by two dipole magnets (scanning magnets) of irradiation system and beams are scanned in the depth direction further by adjusting the energy so as to irradiate a target site. In a case where a scanning irradiation (Raster scanning irradiation), in which a beam having the same energy is continued to apply without stopping as a rule, a current strength of an irradiation beam having the high stability in terms of time is required. The higher the stability is, the easier the control of the irradiation dose is. Accordingly, the amount of a current of an irradiation beam can be increased, and the irradiation time can be reduced.

SUMMARY OF THE INVENTION

The method of extracting a charged particle beam disclosed by JP2003-086399A has the feature such that a radio-frequency electrode dedicated to extraction is not required. However, regarding scanning irradiation method, in a case where the improvement of time stability of a current strength of an irradiation beam is considered so as to shorten the irradiation time, and the easiness of adjustment for performing the above-mentioned matter is considered, there are following problems. A beam to be extracted reflects a particle distribution on a lateral phase plane (the direction vertical to the travelling direction of the beam) and a distribution of particle inside a RF bucket in a longitudinal direction (the travelling direction of the beam). Accordingly, in a case where the stability of irradiation beam current is intended to improve, more accurate adjustment of a radio-frequency voltage to be applied to a radio-frequency cavity, changing speed of frequency, an electric field of a plural of magnets constituting a circular accelerator, etc is required. As a result, there is a case where adjustment is not easy, or a case where an adjustment time increases. In order to solve the above-mentioned problems, this invention aims to provide a circular accelerator which can realize improvement of time stability of an extracting beam current, easy adjustment and short adjustment time.

In order to solve the foregoing problems, the present invention utilizes the following configuration. That is to say, a circular accelerator of this invention comprises a bending magnet which makes a charged particle circulate along a circulating orbit so as to form a charged particle beam; a radio-frequency cavity for accelerating a charged particle; a radio-frequency generator which outputs a radio-frequency to the radio-frequency cavity; a radio-frequency control device which controls a radio-frequency which is generated by the radio-frequency generator; a region division device which divides betatron oscillation of a charged particle which circulates along a circulating orbit into a stable region and a resonance region; an extracting device (for example, septum electrode and septum magnet) for extracting a charged particle from a circulating orbit; and a beam current detector which detects a beam current of a charged particle which is extracted from the extracting device, wherein the radio-frequency control device comprises a target current value memory which stores a target current value of a beam current of a charged particle which is extracted from the extracting device; and a frequency determination part in which a frequency change ratio is obtained by performing a feedback control based on an error signal between a detection signal of a beam current detector and a target current which is stored in the target current value memory and then a subsequent frequency is determined from the obtained frequency change ratio and a current frequency; and stores a subsequent frequency which is determined by the frequency determination part in a frequency memory part so as for the radio-frequency generator to generate a subsequent frequency which is determined.

According to this invention, a circular accelerator, whose control is stable, whose adjustment is simple and whose adjustment time is short, can be obtained.

DETAILED DESCRIPTION OF THE PREFERRED EMBODIMENTS

First of all, the basic theory regarding a circular accelerator according to the present invention will be described. In a case where a circular accelerator is accelerated by an electric field of a radio-frequency cavity which is provided inside the circular accelerator, in addition to betatron oscillation which is generated in two directions orthogonal to the travelling direction of a beam, a charged particle is stably accelerated while a beam is vibrated to the travelling direction of a beam. This oscillation is called as synchrotron oscillation. A charged particle beam in a state of synchrotron oscillation is expressed by equation (1), by using the deviation of magnetic field strength inside a circular accelerator $\Delta B/B_0$ and the displacement of a radio-frequency voltage which is applied to a beam $\Delta f/f_0$, where the frequency $f_0$ and the magnetic field strength $B_0$ before extraction which are designed and is made to be the basis.

$$\frac{\Delta f}{f_0} = \left(\frac{1}{\gamma^2} - \alpha\right)\frac{\Delta p}{p_0} + \alpha\frac{\Delta B}{B_0} \tag{1}$$

Here, $\alpha$ indicates a momentum compaction factor which is the ratio of change of the length of an orbit to displacement of momentum, $\gamma$ indicates a value which is obtained by dividing the energy of a beam when it is extracted by the rest mass energy, $f_0$ indicates a designed frequency, $p_0$ indicates a designed momentum, and $B_0$ indicates a designed dipole magnetic field.

In a case where a magnetic field of a bending magnet is made constant ($\Delta B=0$) in the extracting method disclosed by Patent Document 1, the relationship between the displacement amount of frequency and the displacement amount of momentum is expressed by equation 2.

$$\frac{\Delta f}{f_0} = \left(\frac{1}{\gamma^2} - \alpha\right)\frac{\Delta p}{p_0} \quad (2)$$

Figure 12:
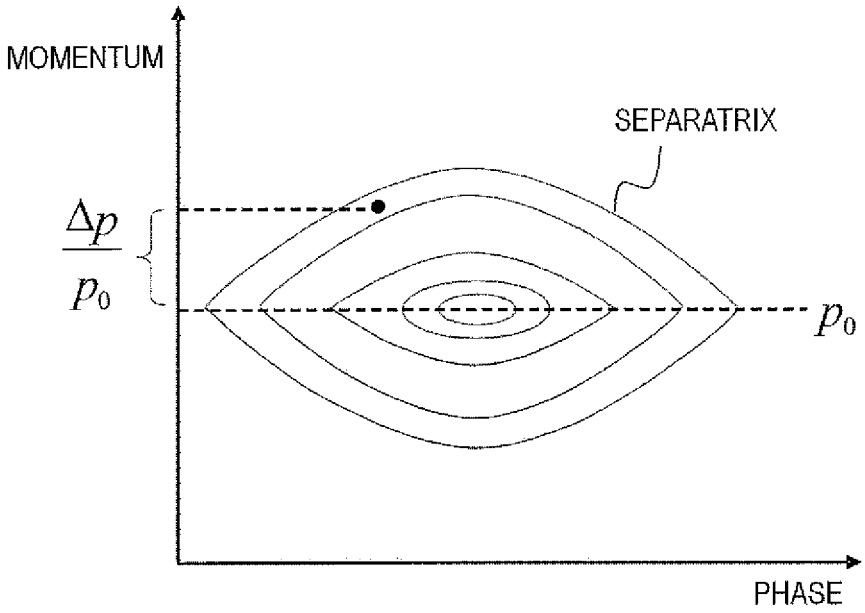
FIG. 12 is a diagram for explaining synchrotron oscillation which is the basis of the present invention.
Figure 13:
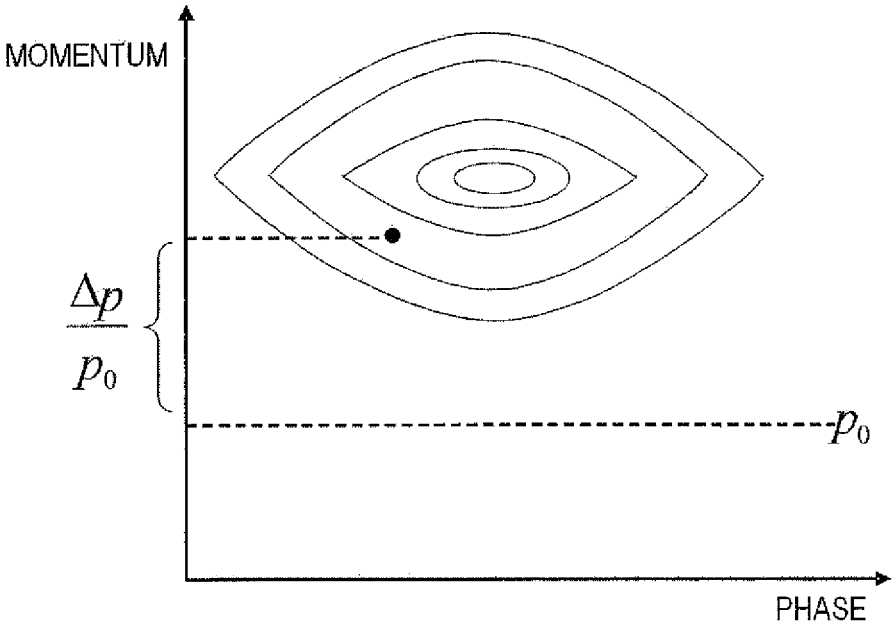
FIG. 13 is a diagram for explaining synchrotron oscillation during extraction which is the basis of the present invention.

Synchrotron oscillation and betatron oscillation when a beam is extracted from a circular accelerator will be described in details. An example of synchrotron oscillation will be described referring to FIG. 12. In FIG. 12, a horizontal axis indicates the phase of a radio-frequency voltage which is applied to each particle, and a vertical axis indicates a momentum. In a case where a dipole magnetic field is constant ($\Delta B=0$), when a frequency of a radio-frequency voltage is changed ($\Delta f$ in the above equation is changed), a beam is accelerated and the momentum is changed as recognized from equation (2). FIG. 13 shows the above-mentioned aspect.

Figure 14:
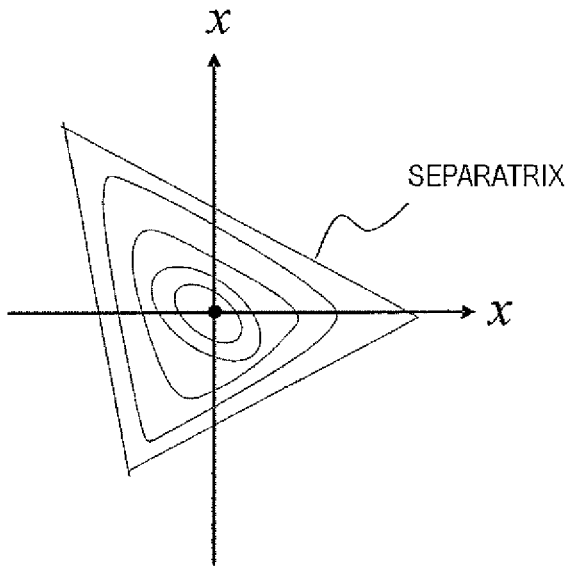
FIG. 14 is a diagram for explaining betatron oscillation when a third order resonance is excited and a separatrix which is the basis of the present invention.
Figure 15:
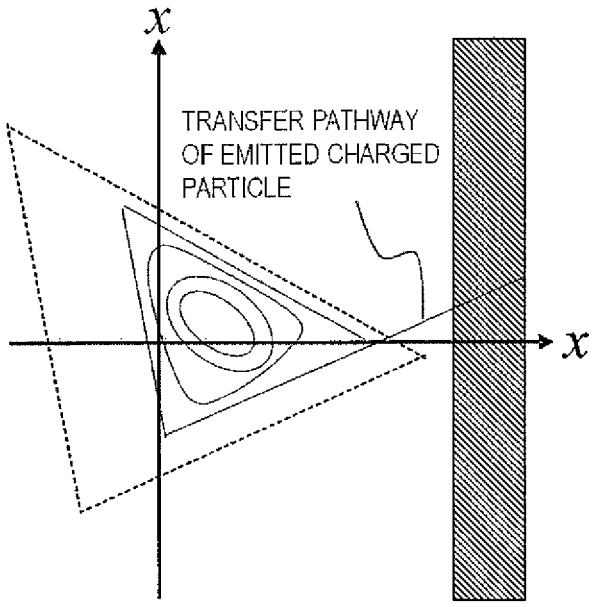
FIG. 15 is a diagram for explaining betatron oscillation when a particle beam is extracted and a separatrix which is the basis of the present invention.

On the other hand, in a case where a beam is viewed from the direction which is orthogonal to the travelling direction of the beam (hereinafter will be referred as lateral direction), when a horizontal axis indicates a position x and a vertical axis indicates the tilt of orbit x', the beam undergoes stable circulating motion, so-called betatron oscillation. When a beam is extracted, for example in a case of third order resonance, third order resonance is excited by a sextupole magnet in a circular accelerator, and betatron oscillation is divided into a stable region and a resonance region. That is, as shown in FIG. 14, a separatrix is formed at a boundary between a stable region and an unstable region of oscillation. In this state, the tune is changed by changing a frequency of a radio-frequency voltage so as to change the momentum, as shown in FIG. 15, a region of a separatrix which is indicated by a triangle shown in a broken line, when a beam is accelerated, is changed to an area which is indicated by a triangle shown in a solid line, when a beam is extracted, so as to narrow a stable region. As a result, a stable region is narrowed so as to expel the particle to an unstable region. Betatron amplitude of a charged particle which is in an unstable region outside of a separatrix is rapidly increased by resonance. In this case, for example, when a septum electrode is provided so as to generate an electric field at a position which is shown by diagonal line in FIG. 15, amplitude is increased, and the power which is generated by an electric field is given to a charged particle which reaches this position. As a result, an orbit can be changed. For example, regarding a charged particle whose orbit is changed to outside, an orbit is largely bended by a septum magnet at the final stage. As a result, the charged particle is extracted from an accelerator.

According to an extracting method according to this invention, once $\Delta f$ is made to be a certain value, for example, $\Delta f=\Delta f_1$, that is, by making a frequency which is applied to a radio-frequency cavity to be $f+\Delta f_1$, the center momentum is changed to be $p+p_1$, and then a beam is extracted. After that, even if a frequency of a radio-frequency voltage is set to be $f+\Delta f_1$, a charged particle to be extracted under this condition is already extracted. Therefore, if a frequency is not further changed, a charged particle will not be extracted. Then, by continuing to change a frequency so as to continue to increase dp/p, a charged particle is extracted. This invention aims to obtain a circular accelerator according to the above-mentioned extracting method, wherein beam current strength can be more stably controlled and its adjustment is easy.

Regarding a method to divide betatron oscillation of a charged particle which circulates along a circulating orbit into a stable region and a resonance region, in addition to a method in which third order resonance is excited by a sextupole magnet; there are various kinds of methods. In this specification of this invention, a method in which third order resonance is excited by a sextupole magnet will be described as an example. That is, in this specification of this invention, a sextupole magnet is a region division device which divides betatron oscillation into a stable region and a resonance region, however, this region division device is not limited to a sextupole magnet.

Embodiment 1

Figure 1:
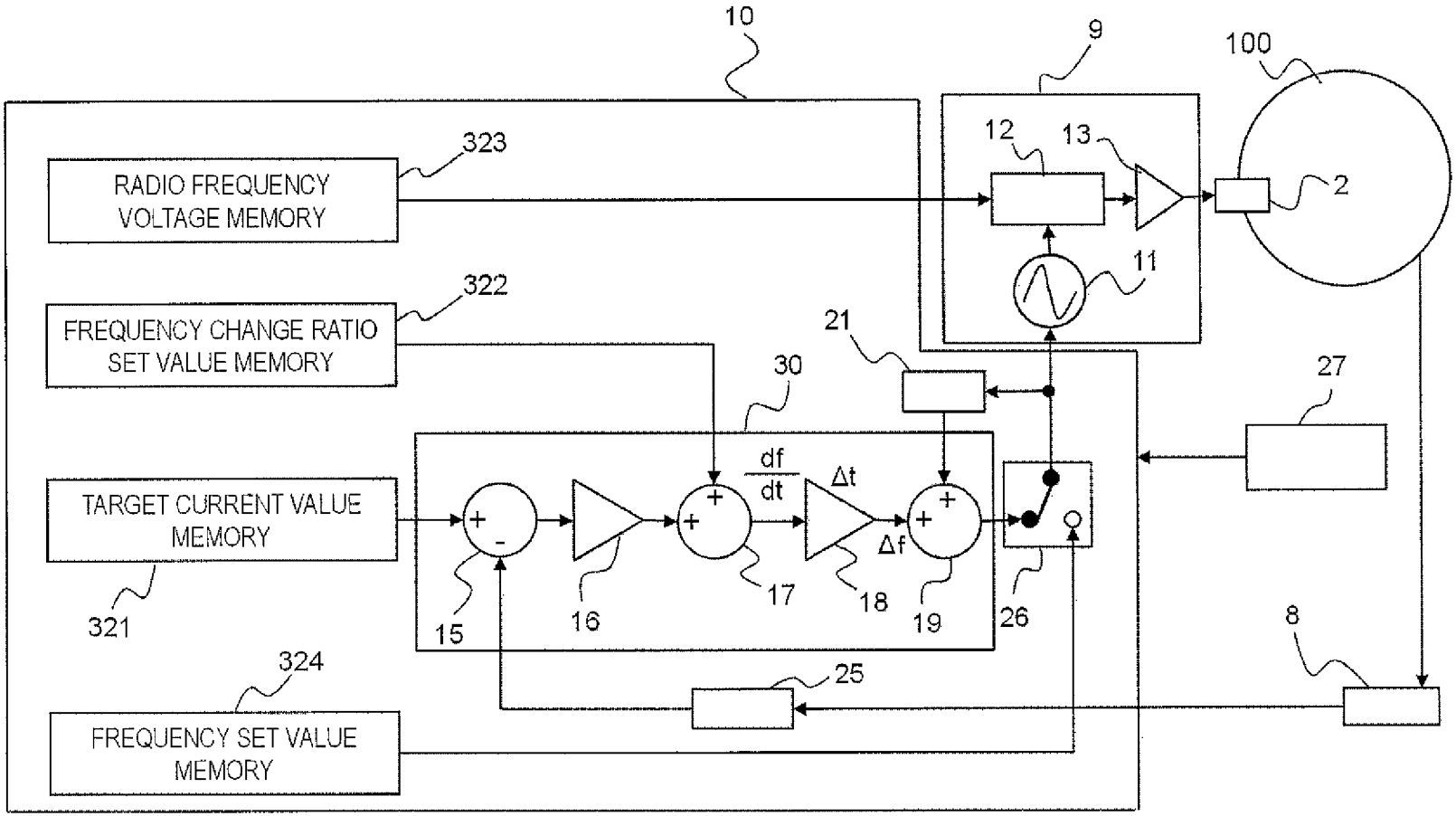
FIG. 1 is a block diagram illustrating a configuration of a radio-frequency control device in details which is an essential part of a circular accelerator according to Embodiment 1 of the present invention.
Figure 2:
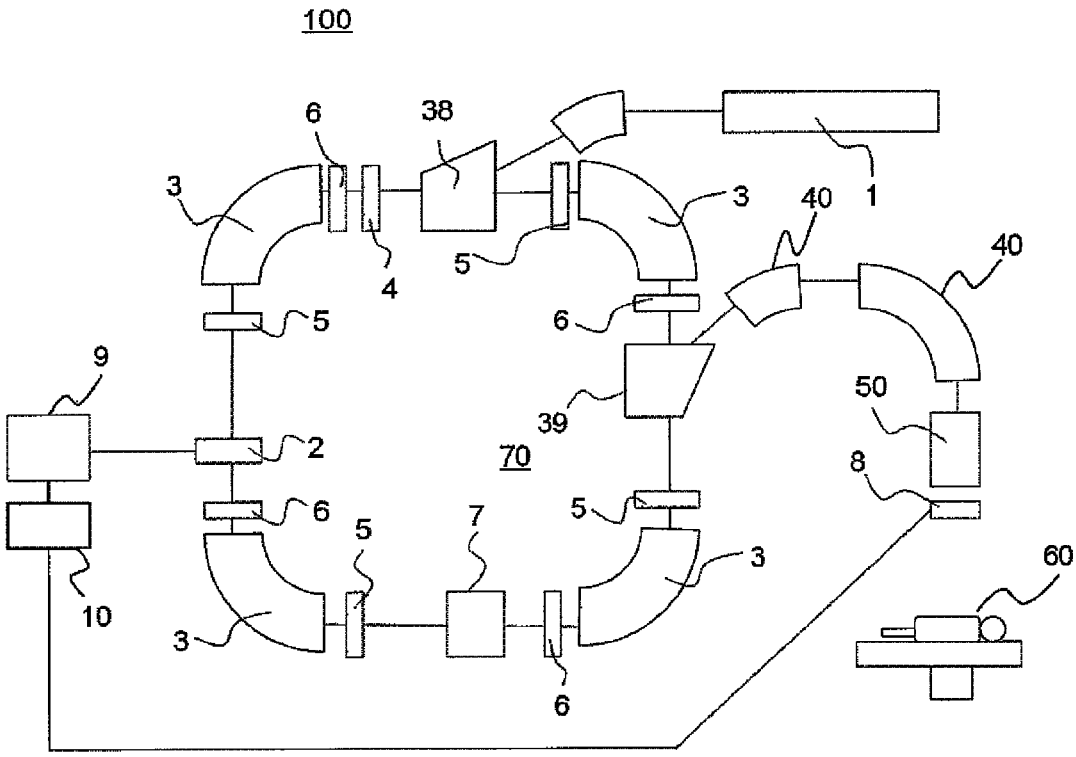
FIG. 2 is a block diagram illustrating a necessary constitutional device in a circular accelerator as a whole according to Embodiment 1 of the present invention.

FIG. 1 is a block diagram illustrating a configuration of a radio-frequency control device in details which is an essential part of a circular accelerator according to Embodiment 1 of the present invention and FIG. 2 is a block diagram illustrating necessary constituent devices in a circular accelerator as a whole according to Embodiment 1 of the present invention. Charged particles, which are accelerated to a sufficient level of energy by an initial-stage accelerator 1 including an ion beam generator, enter a circular accelerator 100 via an injector 38, and then the charged particles are accelerated to intended energy in the circular accelerator 100. Charged particles are accelerated at a radio-frequency cavity 2 in the circular accelerator 100. Further, in the circular accelerator 100, a bending magnet 3 is provided and charged particles are circulated along a circulating orbit so as to form a charged particle beam. In charged particles which are accelerated by the circular accelerator 100, before extraction, third order resonance is excited by a sextupole magnet 4 so as to form a separatrix. As a result, betatron oscillation is divided into a stable region (inside of a separatrix) and a resonance region (outside of a separatrix). That is, the sextupole magnet 4 constitutes a region division device which divides betatron oscillation of charged particles which circulate along a circulating orbit into a stable region and a resonance region. A quadruple magnet 5 is used for adjusting a betatron oscillation frequency and an area of a separatrix. Further, a sextupole magnet 6 adjusts the chromaticity.

Inside the circular accelerator 100, a group of charged particles have the center momentum which is uniquely determined from a magnetic field of the bending magnet 3, and are distributed in the vicinity of the center momentum. Under the above-mentioned state, the center momentum is displaced by using the radio-frequency cavity 2, for example, so as to narrow a stable region of betatron oscillation (an area of separatrix). As a result, charged particles are expelled to a resonance region. Amplitude in an X-direction of a charged particle which enters a resonance region is increased, when the charged particle reaches a region where an electric field of a septum electrode 7 is detected, for example, the charged particle is guided toward an extracting channel by an electric field, an orbit is bent by a septum magnet 39 to the outside of an circular accelerator, and then the charged particle is extracted. That is, the septum electrode 7 and the septum magnet 39 constitute an extracting device 70.

A charged particle beam which is extracted from the circular accelerator 100 is generally guided to a position to be utilized by a transport system comprising a group of magnets 40 of transport system and a vacuum duct. FIG. 2 shows an example in which a charged particle beam is utilized for a particle beam therapy system. A charged particle beam is guided to an irradiation system 50 by a transport system, and an affected area of a patient 60 is scanned by the irradiation system 50, that is, scanning irradiation is performed. A radio-frequency generator 9 which outputs a radio-frequency to be applied to the radio-frequency cavity 2 is controlled by a radio-frequency control device 10 by using a beam current signal, which is a detection signal of a beam monitor 8 which is a beam current detector which measures a current amount of a charged particle beam which is irradiated by the irradiation system 50, as a feedback signal.

Next, referring to FIG. 1, control of beam current amount which is performed by the radio-frequency control device 10 will be described. In Embodiment 1, by using a beam current signal which is detected by the beam monitor 8 as a feedback signal, feedback control of a frequency of a radio-frequency to be applied to the radio-frequency cavity 2 is performed. As recognized from equation 1, a method for displacing the momentum includes a method for changing a magnetic field, a method for changing a frequency or a method for changing both of the magnetic field and the frequency. In comparison with the change of a frequency of a radio-frequency, the response speed of change of the bending magnet 3 is slow. Consequently, control of a frequency of a radio-frequency to be applied to the radio-frequency cavity 2 is most effective.

Here, regarding the operation of a circular accelerator, the timing of acceleration, deceleration, start of extraction and termination is performed by a timing signal which is transmitted from an external timing system 27. According to a timing signal which is transmitted from the timing system 27, the radio-frequency control device 10 transmits a voltage signal and a frequency corresponding to the timing, to the radio-frequency generator 9. A voltage signal is stored in a radio-frequency voltage memory 323, and the voltage signal is transmitted to an amplitude controller 12. Regarding control of a frequency, a timing signal which is transmitted from the timing system 27 controls a changeover switch 26 so as to switch the control. In periods except for an extracting period, frequency data in a frequency set value memory 324 where a frequency which is necessary for acceleration, etc. is stored, is transmitted directly to a radio-frequency generator 9. That is, in periods except for an extracting period, a frequency is determined by a feed-forward control. On the other hand, during extraction, frequency data, which is determined by performing a feedback control by a frequency determination part 30, is transmitted. However, for example, in a case where a feedback control is not performed during extraction, or in a case where a feedback control is not performed for a part of period, a frequency during extraction may be stored in the frequency set value memory 324.

The radio-frequency control device 10 as a feedback control system is constituted as follows. For example, in a case of a particle beam therapy system, an amount of charged particles, which is determined by the required amount of irradiation dose for a therapy, that is, a value of a beam current, is stored in a target current value memory 321 as a target current value. The ratio of changing a frequency of a radio-frequency for taking out charged particles of this target current value from the circular accelerator 100, that is, the frequency change ratio is stored in a frequency change ratio set value memory 322. The frequency change ratio which is stored in the frequency change ratio set value memory 322 is generally stored as a time series data from the start of extraction.

A current comparator 15 outputs an error signal between a signal which is obtained by filtering a beam current signal (feedback signal) which is measured by the beam monitor 8 with a low-pas filter and a target current value which is stored in the target current value memory 321. In a frequency change ratio correction value computing unit 16, computing of proportion, integration and derivation (PID) is performed on an error signal as output from the current comparator 15, a gain of PID computing for determining the appropriate frequency change ratio correction value is obtained by, for example, a transfer function of control system which is previously measured or analysis.

Next, in a frequency change ratio corrector 17, a frequency change ratio df/dt is determined by adding a frequency change ratio set value which is stored in the frequency change ratio set value memory 322 to a frequency change ratio correction value which is determined by the frequency change ratio correction value computing unit 16. In a multiplier 18, computing of a frequency change value $\Delta f$ is performed by multiplying a frequency change ratio df/dt which is determined by a frequency change ratio corrector 17 by the clock period $\Delta t$ of the radio-frequency control device 10. In a frequency controller 19, by adding a frequency change value $\Delta f$ which is obtained by the multiplier 18 to a current frequency value which is stored in a frequency memory 21, a frequency which is generated by the radio-frequency generator 9 one clock after, that is, which is generated subsequently, is determined.

As above mentioned, in a frequency determination part 30 comprising the current comparator 15, the frequency change ratio correction value computing unit 16, the frequency change ratio corrector 17, the multiplier 18 and the frequency controller 19, by performing feedback control based on an error signal between a detection signal of the beam monitor 8 and a target current value which is stored in the target current value memory 321, a frequency change ratio which is stored in the frequency change ratio set value memory 322 is corrected so as to determine a frequency.

A radio-frequency generator 11 (for example, direct digital synthesizer) outputs a radio-frequency signal of a predetermined frequency using a value of a frequency which is outputted from the frequency controller 19 as an input signal. Further, a frequency which is determined by the frequency controller 19 is stored in a frequency memory 21. In the amplitude controller 12, a voltage of a radio-frequency signal which is outputted from the radio-frequency signal generator 11 is made to be a predetermined value of voltage which is outputted from the radio-frequency voltage memory 323, a radio-frequency signal of a predetermined value of a voltage is amplified by a radio-frequency amplifier 13, and then is applied to the radio-frequency cavity 2. The radio-frequency generator 11, the amplitude controller 12 and the radio-frequency amplifier 13 constitute the radio-frequency generator 9.

Further, generally, in circular accelerators, particles are accelerated to the speed which is close to light speed. Therefore, it is required for the radio-frequency control device 10 to have the high-speed control which is 1/1000 second or less. In order to realize the above-mentioned, FPGA (Field-Programmable Gate Array) or DSP (Digital signal processor) is used as the radio-frequency control device excluding a memory part 10.

Further, in a case where a circular accelerator according to this invention is applied to a particle beam therapy system, an objective of the particle beam therapy system is to apply a precise beam irradiation to an affected part. Therefore, it is preferable that the beam monitor 8 is provided as close to a patient as possible. On the other hand, the radio-frequency control device 10 which controls a frequency of a radio-frequency is digital equipment. Therefore, in many cases, a radio-frequency control device is not provided in a place where radiation is generated, but in a place distant from the place where radiation is generated. Accordingly, there is a case where signal transmission distance between the beam monitor 8 and the radio-frequency control device is several tens meters or more. Consequently, effect of feedback control may be deteriorated due to transmission loss of feedback control or signal deterioration caused by noise. In this case, the above-mentioned deterioration of the effect of feedback control can be prevented by providing an electro-optical conversion device and a photoelectric conversion device in a place between the beam monitor 8 and the radio-frequency control device 10 so as to transmit a feedback signal by an optical signal. Further, as shown in FIG. 1, a signal from the beam monitor 8 is inputted to the current comparator 15 via a low-pass filter 25. It is not always necessary to use the low-pass filter 25, however, a radio-frequency component of a feedback signal such as noise may cause instability of feedback control. Therefore, it is preferable that the low-pass filter 25, which attenuates a radio-frequency signal of several kHz or higher, is used.

A reason why a feedback control is effective to control a current according to a target value will be described. According to the extracting method of this invention, a charged particle beam is extracted from the circular accelerator 100 by displacing the center frequency so as to displace the momentum. However, it is difficult to know previously the particle distribution on a lateral phase plane (the direction vertical to the travelling direction of a beam) and the distribution of particle inside a RF bucket in a longitudinal direction (the traveling direction of a beam). Therefore, it is extremely difficult to extract a charged particle beam having a high time stability for performing scanning irradiation. Further, fluctuation with respect to time is given to a magnetic field of the bending magnet 3 due to an inevitable factor in reality such as power supply ripple. Therefore, in a precise sense, it is difficult to make a magnetic field error ΔB to be zero. As a result, the momentum is fluctuated. Further, in addition to the bending magnet 3, for example, in the quadruple magnet 5, a magnetic field error contributes to the change of tune. When the above-mentioned magnetic field error is included, by performing a feedback control by using Δf which is previously determined, it becomes more difficult to control a beam current.

Further, in the extracting method according to this invention, in a case where a feedback control of Δf (frequency is center frequency $f_0+\Delta f$) is attempted, after a beam is extracted in a certain frequency once, even if the frequency is returned to the same frequency, an extracting current of almost the same level can not be obtained. This is because such that most of charged particles to be extracted in the frequency are already extracted. In a precise sense, as synchrotron oscillation is generated in a charged particle in the RF bucket, when a frequency is the same, a beam continues to be extracted to some extent. In a case where a magnetic field error is generated, if dp/p is not the same, a beam may be extracted even if a frequency is the same. As above-mentioned, even if Δf feedback control which is performed so as to stabilize the acceleration in general is applied to an extracting beam current control, it is difficult to control an extracting beam current to be constant with respect to time.

When physics of beam extraction from a synchrotron is considered, it is found out such that an amount of beam current to be extracted is not determined by a frequency change amount Δf with respect to the center frequency $f_0$. An amount of an extracting beam current at this time is determined by how a current frequency changes with respect to a frequency in the past, that is, slope of frequency with respect to time of a frequency (frequency change ratio). Inventors of this invention paid attention to the above-mentioned and found out such that in a case where a feedback control is performed by obtaining a frequency change ratio correction value, it is effective to compute a value of subsequent frequency by using this frequency changing ratio correction value, not from $f_0$ which is known previously from the design but from a frequency value which is determined only in real time.

When the above-mentioned control is expressed by equation, it is expressed by equation (3). When a frequency at a certain time t is indicated by f(t), by performing a feedback control of df(t)/dt which is time change ratio of f(t), it is found out such that extracting beam current strength can be effectively controlled.

$$f(t)=f(t-\Delta t)+\dot{f}(t)\times\Delta t \tag{3}$$

One of features of feedback control system according to this invention is to provide the frequency memory 21 which stores a frequency in order to perform the control expressed by equation (3). On this occasion, it is possible to design an approximate value of frequency change ratio so as to extract a charged particle of a target value of a current, a set value of frequency change ratio is previously determined so as to store in the frequency change ratio set memory 322. As expressed by equation (4), when a feedback control is performed on a correction value from the frequency change ratio set value, feedback gain is reduced, and control becomes more stable.

$$f(t)=f(t-\Delta t)+(\dot{f}_0(t)+\dot{f}(t))\times\Delta t \tag{4}$$

Further, a dot in equation (3) and equation (4) indicates time differential. This equation (4) can be realized by the configuration shown in FIG. 1.

Figure 3:
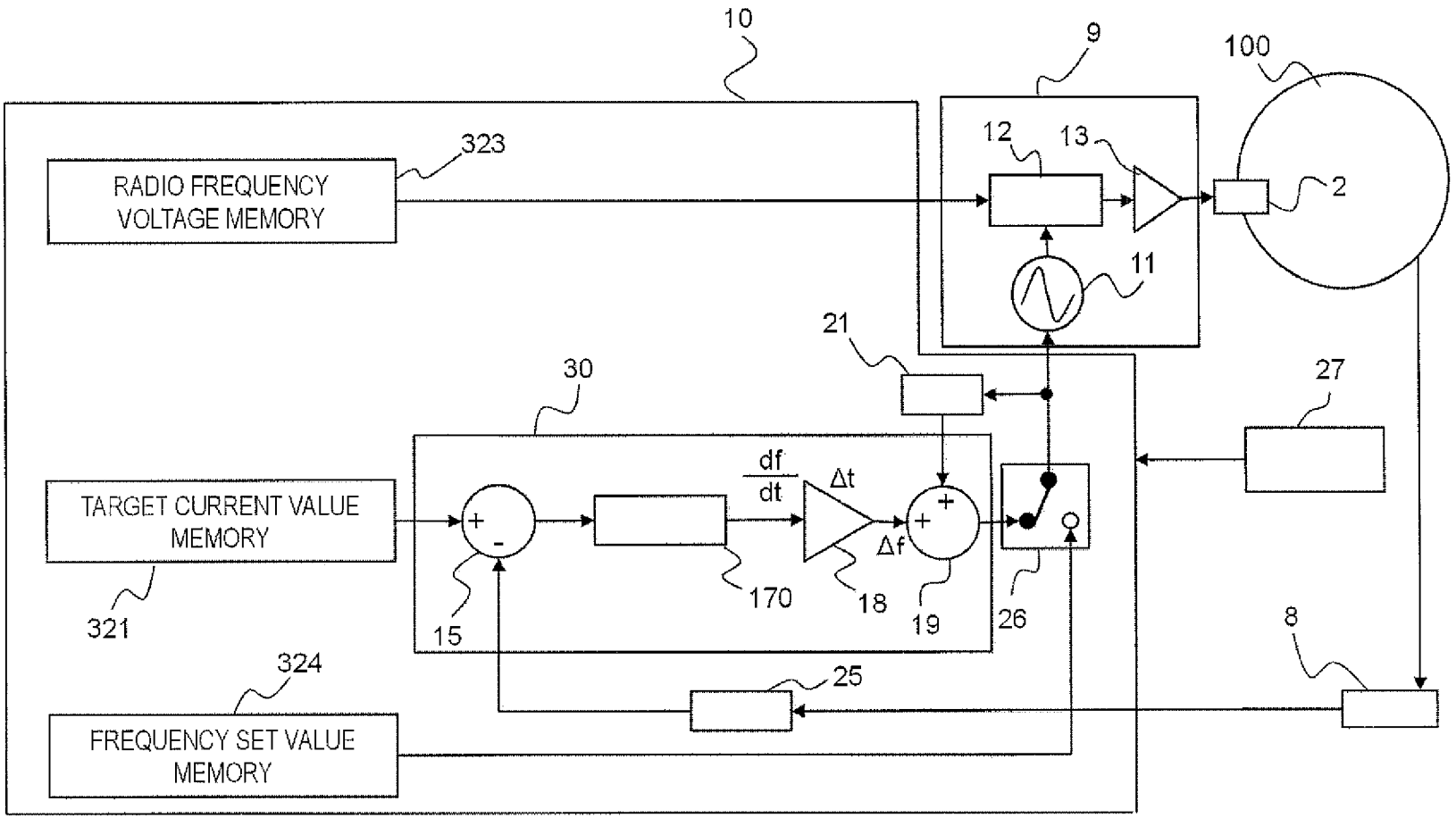
FIG. 3 is a block diagram illustrating another configuration of a radio-frequency control device in details which is an essential part of a circular accelerator according to Embodiment 1 of the present invention.

Further, a configuration may be formed so as to directly realize equation (3). That is, a configuration as shown in FIG. 3 is formed. In FIG. 3, the sign which is the same as that in FIG. 1 shows a same part or a corresponding part. In the configuration shown in FIG. 3, the frequency change ratio set memory 322 shown in FIG. 1 is not provided. An error signal which is difference between a target current value which is stored in the target current value memory 321 and a current signal which is measured by the beam monitor 8 is outputted by the current comparator 15. In a frequency change ratio computing unit 170, a frequency change ratio is obtained by directly computing from an error signal which is outputted from the current comparator 15. By using the obtained frequency change ratio, in the multiplier 18 and the frequency controller 19, the subsequent frequency, that is, a frequency which is generated one clock after, is determined.

Figure 4:
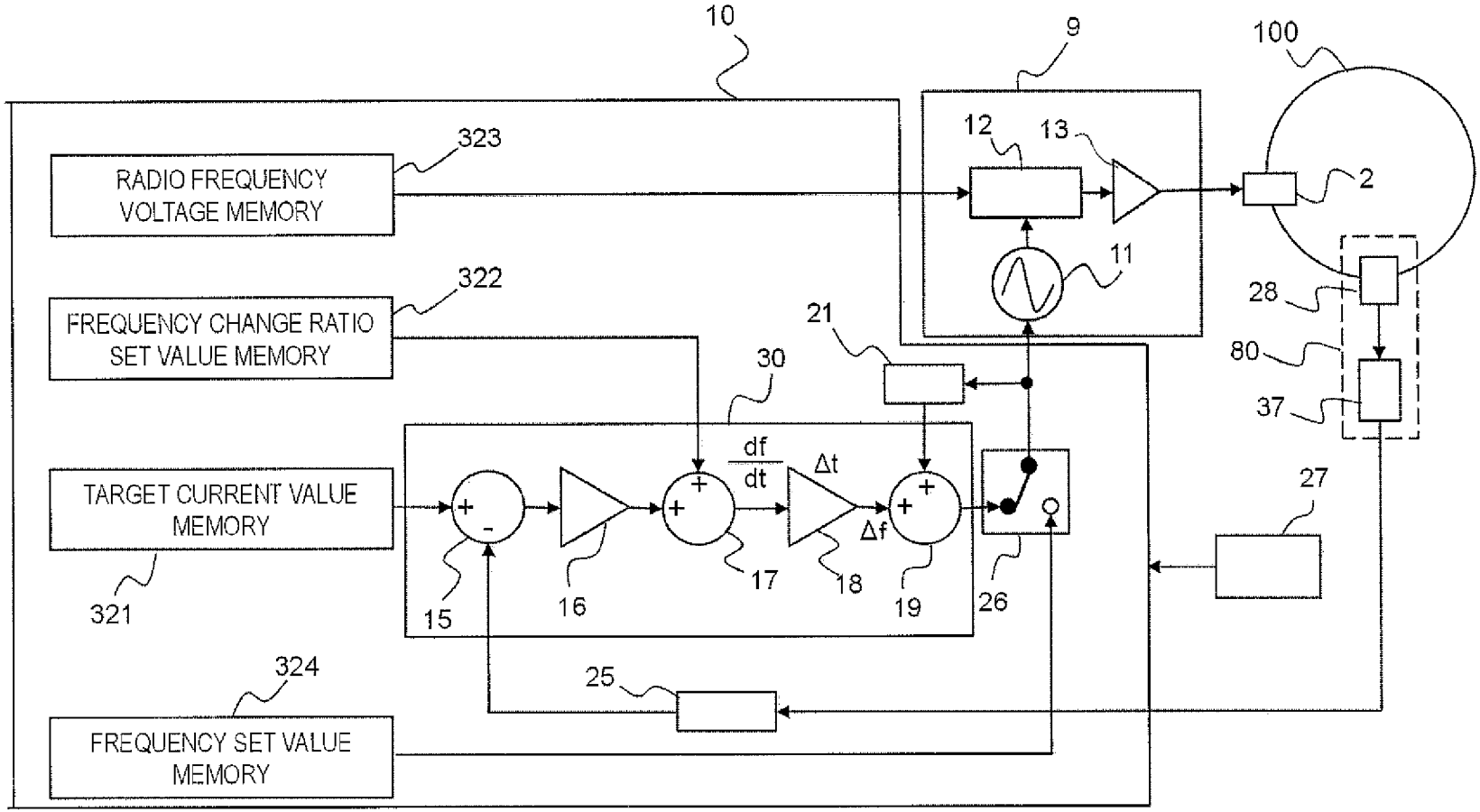
FIG. 4 is a block diagram illustrating another configuration of a radio-frequency control device in details which is an essential part of a circular accelerator according to Embodiment 1 of the present invention.

Further, a beam current value which is extracted from a circular accelerator can be obtained by using a signal of a remaining beam current in the circular accelerator. As a remaining current monitor, for example, DCCT (DC current transformer) may be used. FIG. 4 shows an example of configuration in which DCCT is used as a remaining beam current monitor 28. In FIG. 4, the sign which is the same as that in FIG. 1 shows a same part or a corresponding part. DCCT is a monitor for measuring a remaining beam current amount in a circular accelerator. Consequently, unlike the beam monitor 8 shown in FIG. 1, time change of a remaining beam current value is a current value to be extracted. Therefore, a differential computing unit 37 is used. An output signal of the differential computing unit 37 is a beam current value. Therefore, this signal can be used as a feedback signal. That is, the remaining beam current monitor 28 and the differential computing unit 37 constitute a beam current detector 80.

As above mentioned, in the circular accelerator according to Embodiment 1 of this invention, a target current value of beam current of charged particles which are extracted from an extracting device 70 is stored in the target current value memory 321, in the frequency determination part 30, a feedback control is performed based on an error signal between a signal of a beam current detector and an target current value which is stored in the target current value memory 321 so as to obtain a frequency change ratio, and a subsequent frequency is determined from the obtained frequency change ratio and a current frequency. According to the above-mentioned configuration, a circular accelerator whose control is stable, and which can extract a stable beam current according to the target value by performing simple adjustment can be obtained.

Embodiment 2

Figure 5:
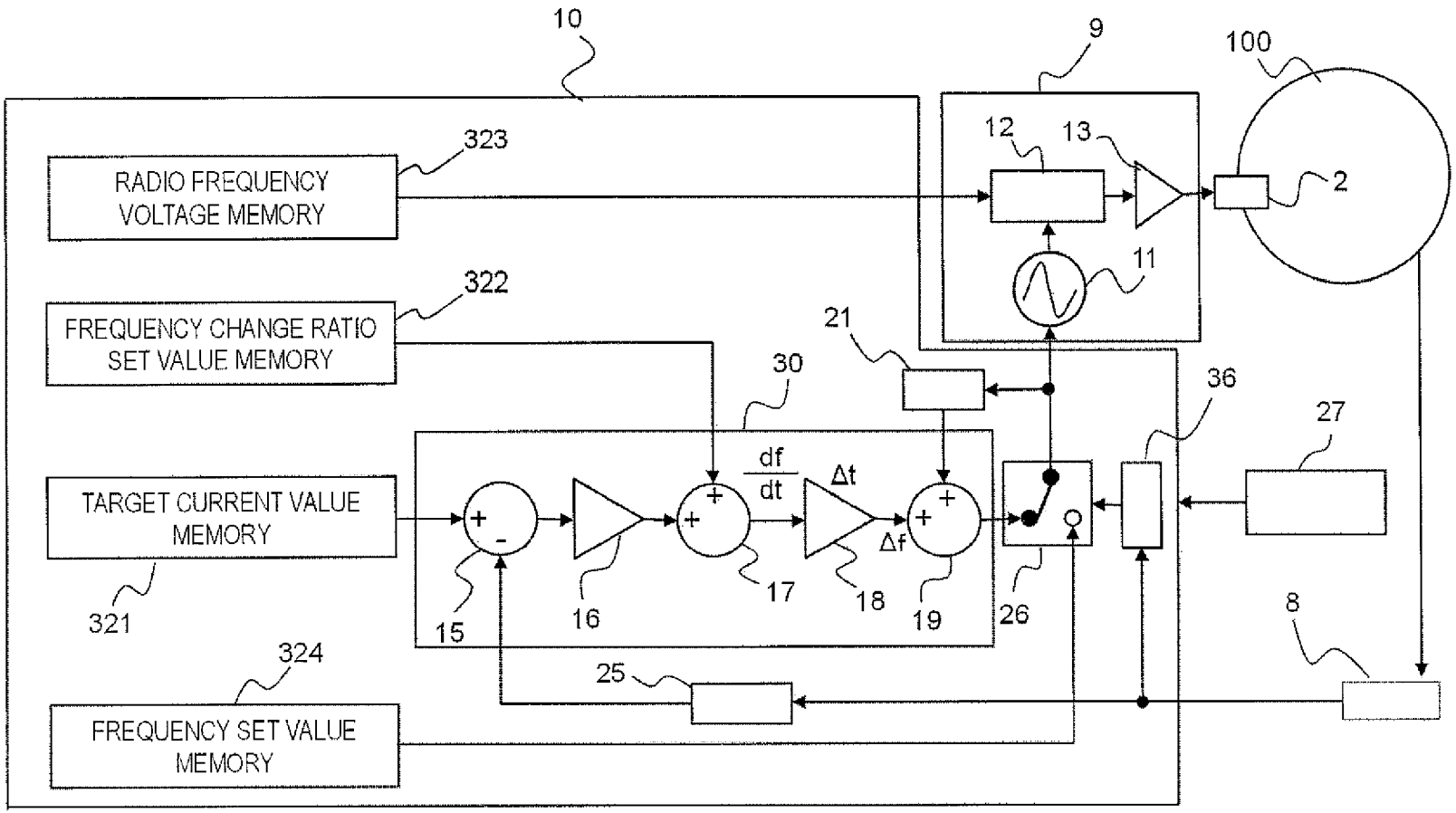
FIG. 5 is a block diagram illustrating a configuration of a radio-frequency control device in details which is an essential part of a circular accelerator according to Embodiment 2 of the present invention.

FIG. 5 is a block diagram illustrating a configuration of a radio-frequency control device in details which is an essential part of a circular accelerator according to Embodiment 2 of the present invention. In FIG. 5, the sign which is the same as that in FIG. 1 shows a same part or a corresponding part. In Embodiment 2, an internal timing system 36 which refers to a signal of the beam monitor 8 is provided inside the radio-frequency control device 10. In Embodiment 1, regarding the operation of a circular accelerator, the timing of acceleration, deceleration, start of extraction and termination is performed by a timing signal which is transmitted from the external timing system 27. During extraction, a frequency which is determined by a feedback control is outputted by the radio-frequency control device 10 to a radio-frequency generator 9.

However, if an extraction is performed only by a feedback control, there are hardly charged particles to be extracted just after the extraction starts. Consequently, an extremely large feedback gain is given. Therefore, there is the possibility such that overshoot is caused on a beam current to be extracted. A feedback gain can be set to be small in advance, however, when a gain is set to be too small, it takes time for a beam current to rise up. In order to solve the above-mentioned, a feed-forward control is performed by using data in a frequency set value memory 324 until a certain current starts to be extracted, after that, the feed-forward control is switched to a feedback control. As a result, control of stable beam current with fast rise can be realized.

When a beam current signal is once transmitted to the timing system 27 outside of the radio-frequency control device 10 in order to monitor a beam current to switch, delay may be caused. Therefore, instead of the above-mentioned, by monitoring a beam current to switch inside the radio-frequency control device 10, an operation of switch from a feed-forward control to a feedback control can be performed more rapidly, that is, more effectively. In Embodiment 2, the internal timing system 36 is provided inside the radio-frequency control device 10, and the internal timing system 36 transmits a command to a changeover switch 26 based on a beam current signal from the beam monitor 8 so as to switch a feed-forward control to a feedback control. As a result, control of stable beam current with fast rise can be realized.

Further, in a case where optimal time from starting of extraction to starting of feedback control is previously known, instead of switching from a feed-forward control to a feedback control based on a current signal from the beam monitor 8, by switching a feed-forward control to a feedback control after the lapse of a predetermined time after the starting of extraction which is previously set, control according to a target current can be performed at high speed.

Further, it is needless to say such that a signal of a beam current detector 80 comprising a remaining beam current monitor 28 and a differential computing unit 37 as shown in FIG. 4 may be used as a beam current signal. In following embodiments, the above-mentioned is applicable.

Embodiment 3

Figure 6:
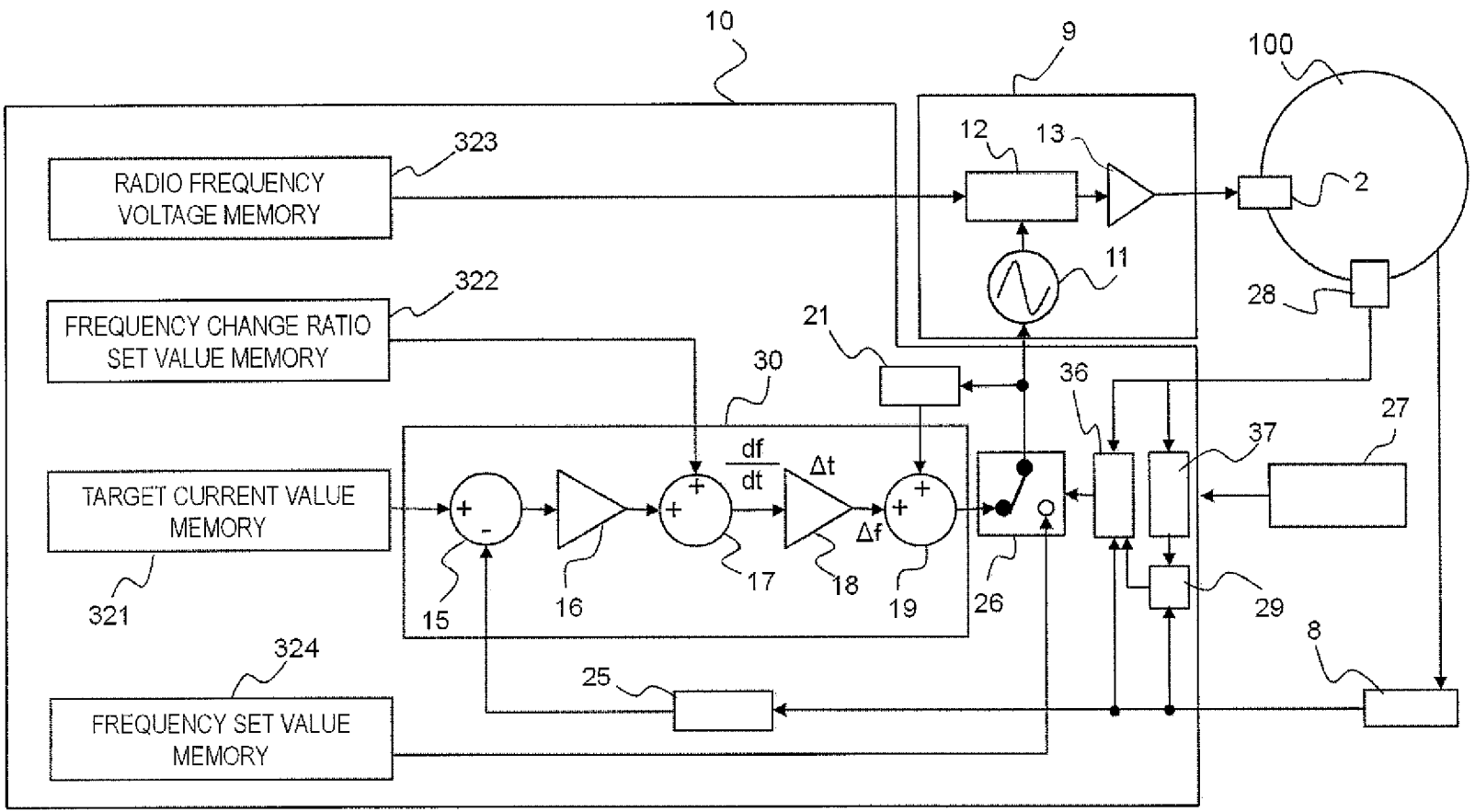
FIG. 6 is a block diagram illustrating a configuration of a radio-frequency control device in details which is an essential part of a circular accelerator according to Embodiment 3 of the present invention.

FIG. 6 is a block diagram illustrating a configuration of a radio-frequency control device in details which is an essential part of a circular accelerator according to Embodiment 3 of the present invention. In FIG. 6, the sign which is the same as that in FIG. 1, FIG. 4 and FIG. 5 shows a same part or a corresponding part. In Embodiment 3, a remaining beam current monitor 28 which measures a remaining beam current amount in a circular accelerator is provided. When a current amount which is obtained by differentially computing a signal of the remaining beam current monitor 28 with a differential computing unit 37 and an electric beam current value which is measured by a beam monitor 8 are not the same, it is found out such that a beam which is extracted is lost between a synchrotron and the beam monitor 8. Consequently, by transmitting a signal from a comparator 29 which compares both of them to an internal timing system 36, the signal from the comparator can be utilized as a signal for stopping extraction.

Further, a signal from the remaining beam current monitor is a remaining beam current value signal in a circular accelerator. Consequently, when the internal timing system 36 judges such that an amount of a remaining beam is small according to a signal of the remaining beam current monitor itself, an extraction can be terminated. When an amount of a remaining beam is small, a beam to be extracted can not be controlled even if any feedback control is performed. Consequently, there is an effect such that unstable control of extraction in this case can be prevented.

Embodiment 4

Figure 7:
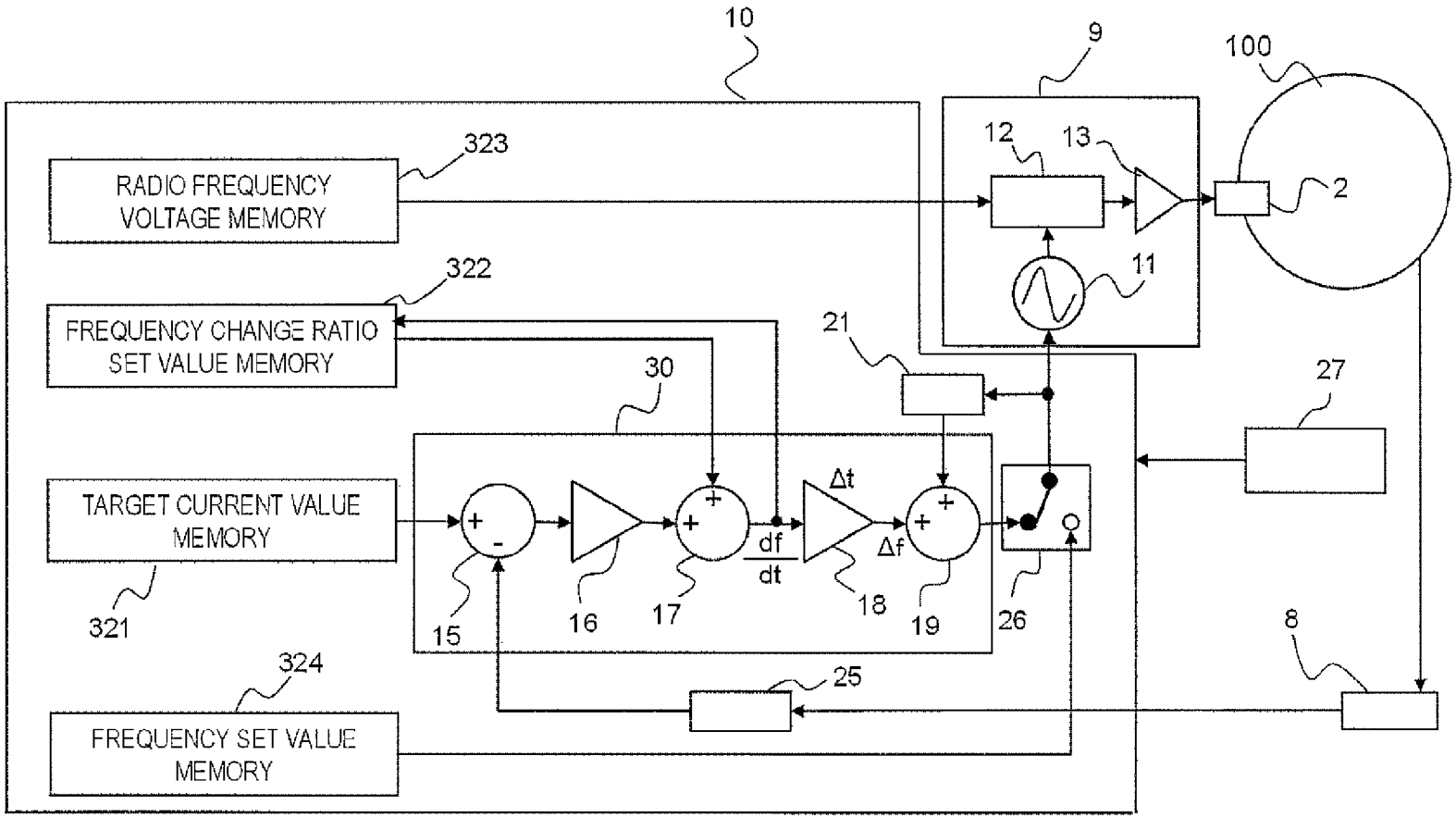
FIG. 7 is a block diagram illustrating a configuration of a radio-frequency control device in details which is an essential part of a circular accelerator according to Embodiment 4 of the present invention.

FIG. 7 is a block diagram illustrating a configuration of a radio-frequency control device in details which is an essential part of a circular accelerator according to Embodiment 4 of the present invention. In FIG. 7, the sign which is the same as that in FIG. 1 shows a same part or a corresponding part. As described in Embodiment 1, in a case of the extracting method according to this invention, a beam to be extracted reflects a particle distribution on a lateral phase plane or a distribution of particle inside a RF bucket in a longitudinal direction; however, it is difficult to know these particle distributions in advance. Consequently, it is difficult to precisely control a beam current value to be extracted to be a target current value by performing a feed-forward control. In this invention, a feedback control of a frequency change ratio is performed. Consequently, an extracting beam current can be stabilized by controlling the speed of change of momentum change ratio. As a result, an effect of disturbance due to magnetic filed fluctuations can be reduced by performing a feedback control. Among these, since the above-mentioned effect has high reproducibility, a frequency change ratio which is determined after the feedback, is stored in a frequency change ratio set value memory 322, for example. When a beam is extracted during subsequent acceleration, a frequency change ratio set value data which is determined by design in advance is not used but a frequency change ratio data which is obtained by the previous feedback control is used. Then, feedback gain can be reduced by making an effect of disturbance due to magnetic field fluctuation a correction value of this data. A control method of Embodiment 4 of this invention has an effect of higher stability of control, since a feedback gain is small.

Embodiment 5

Figure 8:
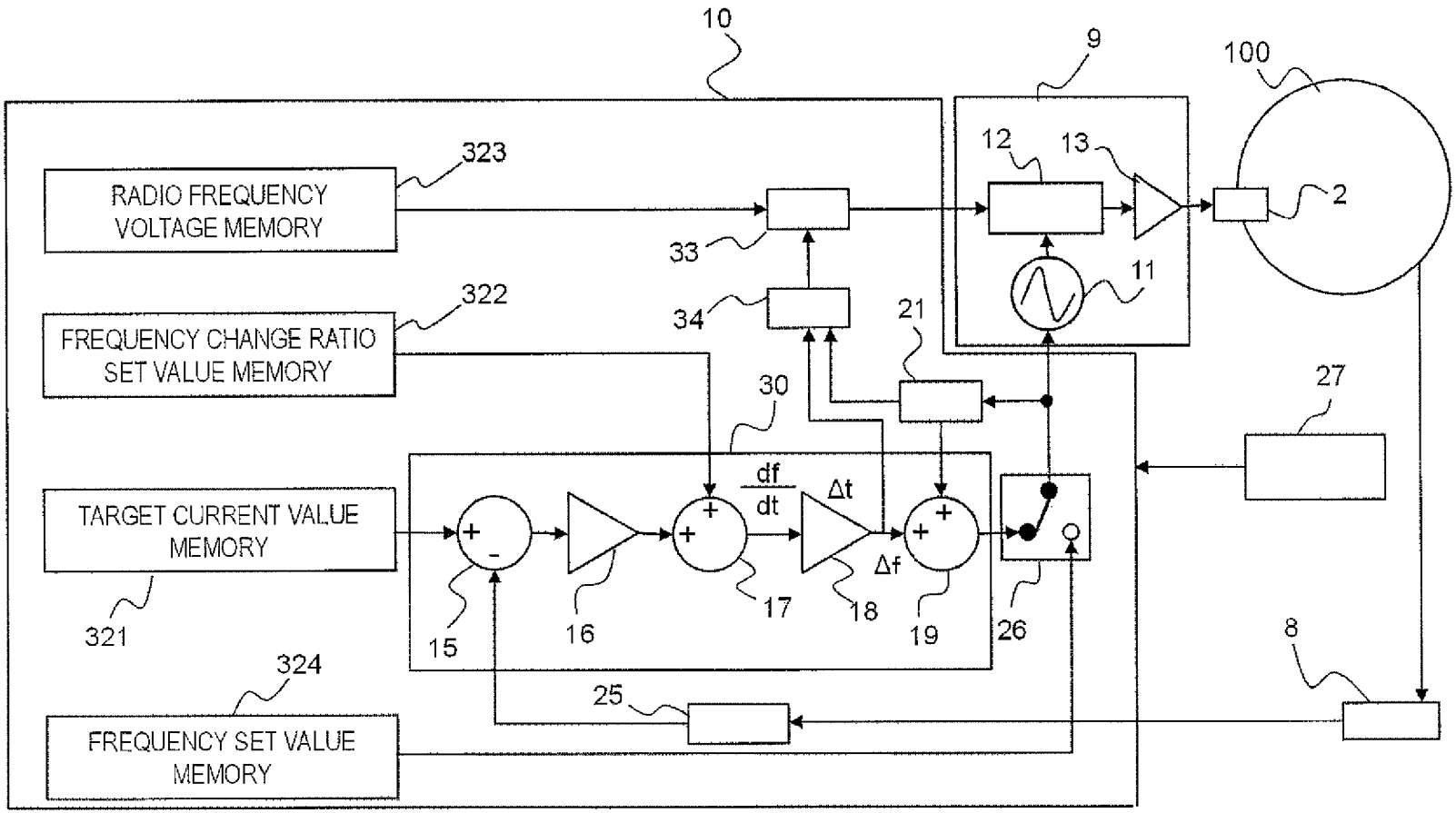
FIG. 8 is a block diagram illustrating a configuration of a radio-frequency control device in details which is an essential part of a circular accelerator according to Embodiment 5 of the present invention.

FIG. 8 is a block diagram illustrating a configuration of a radio-frequency control device in details which is an essential part of a circular accelerator according to Embodiment 5 of the present invention. In FIG. 8, the sign which is the same as that in FIG. 1 shows a same part or a corresponding part. In Embodiment 5, a voltage computing unit 34 which obtains a voltage value from a current frequency value and Δf value which determines a subsequent frequency, and a changeover switch 33, for switching a voltage value from a radio-frequency voltage memory 323 to a voltage value which is obtained by the voltage computing unit 34, are provided. In the extracting method according to this invention, extraction is performed by changing momentum displacement (by increasing energy), the optimum voltage value changes momentarily. In a case where extraction is performed by a feed-forward control, since a frequency value is known in advance, an energy value to be accelerated is known in advance. As a result, by forecasting an optimum voltage value in advance, the obtained voltage value is stored in the radio-frequency voltage memory 323 so as to change a voltage by a feed-forward control.

On the other hand, in a case where a feedback control is performed, with respect to elapse time after extraction, precise frequency value can not be known in advance. In a case where a voltage value to be applied to a radio-frequency cavity 2 is not the optimum value, since a particle leaks from a bucket shown in FIG. 13 (even if a frequency is changed, a particle which leaks from the bucket is not accelerated), extracting efficiency is decreased. Consequently, a subsequent voltage value is determined by computing from a current frequency value and Δf value for determining a subsequent frequency value. By the above-mentioned computing, a voltage value which is transmitted to an amplitude controller 12 becomes a value by which an area of bucket (inside of a separatrix) shown in FIG. 13 is not reduced. As above-mentioned, when a feed-forward control is performed, a voltage value which is stored in the radio-frequency voltage memory 323 is transmitted to a radio-frequency generator 9, when a feedback control is performed, switching is performed by a changeover switch 33, and a voltage value which is obtained by the voltage computing unit 34 is transmitted to the radio-frequency generator 9. According to the above-mentioned configuration, while a feedback control is performed, a radio-frequency of an optimum voltage, corresponding to a current frequency, is applied to the radio-frequency cavity 2. As a result, there is an effect such that extracting efficiency can be increased.

Embodiment 6

Figure 9:
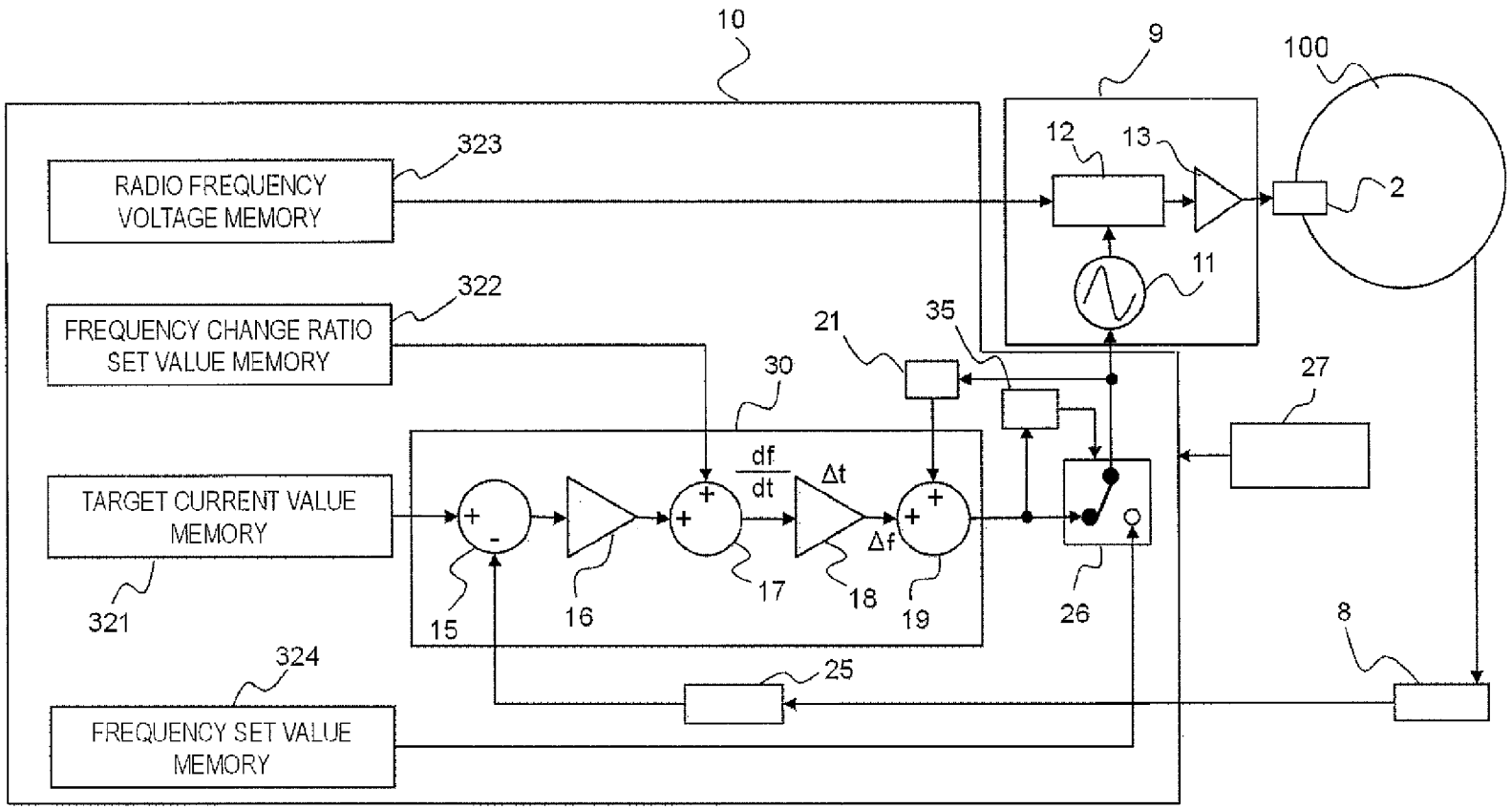
FIG. 9 is a block diagram illustrating a configuration of a radio-frequency control device in details which is an essential part of a circular accelerator according to Embodiment 6 of the present invention.

FIG. 9 is a block diagram illustrating a configuration of a radio-frequency control device in details which is an essential part of a circular accelerator according to Embodiment 6 of the present invention. In FIG. 9, the sign which is the same as that in FIG. 1 shows a same part or a corresponding part. In Embodiment 6, a frequency comparator 35 is provided. According to the extracting method of this invention, extraction is performed by accelerating a beam so as to change the momentum. In a case where a feedback control is not performed, since a frequency value is determined in advance, an energy which is reached during extraction can be known in advance. Consequently, a frequency change within a range of energy in which extraction is intended to perform can be designed in advance. However, in a case where a feedback control is performed, a value of frequency which is arrived finally can not be known in advance. That is, an energy range to be extracted can not be forecasted in advance. Then, a value of final arrival frequency is held, the comparator 35, which compares the obtained value and a value of a frequency after the feedback, is provided. In a case where it is judged such that a frequency after a feedback is changed to the final arrival frequency, a feedback control stopping signal which stops a feedback control is transmitted to a switch 26, particles which remain in a circular accelerator are removed, and initialization of acceleration is performed. Accordingly, a feedback control can be effectively performed, and extraction within a designed energy range can be performed.

Embodiment 7

Figure 10:
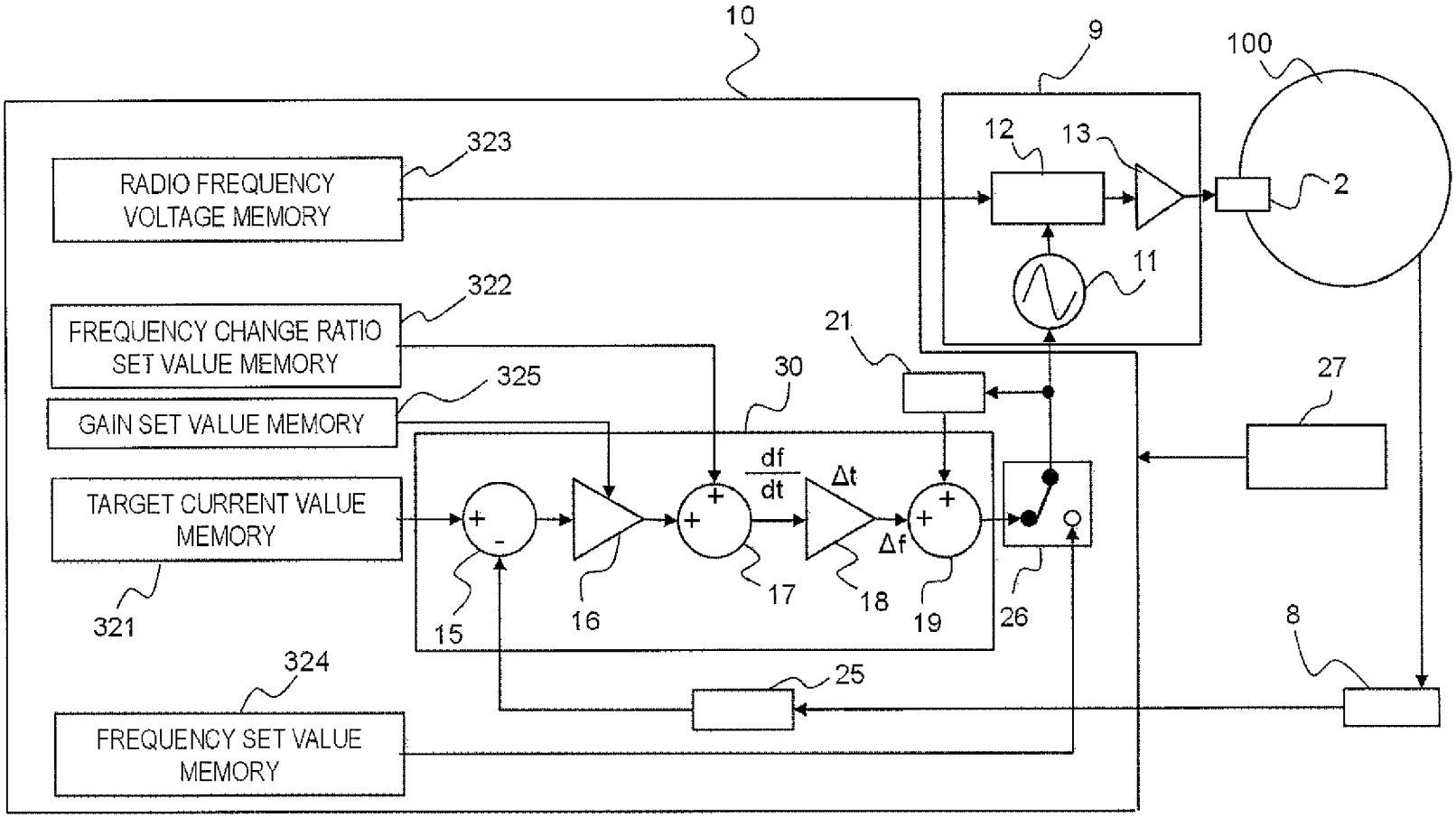
FIG. 10 is a block diagram illustrating a configuration of a radio-frequency control device in details which is an essential part of a circular accelerator according to Embodiment 7 of the present invention.

FIG. 10 is a block diagram illustrating a configuration of a radio-frequency control device in details which is an essential part of a circular accelerator according to Embodiment 7 of the present invention. In FIG. 10, the sign which is the same as that in FIG. 1 shows a same part or a corresponding part. In Embodiment 7, in order to change a gain of a frequency change ratio correction value computing unit 16 according to time, a gain set value memory 325 which previously stores a time change of set value of gain is provided. In an extracting method of this invention, it is strongly affected by the particle distribution inside a RF bucket, and it is also affected by particle distribution on a lateral phase plane. Consequently, an appropriate value of feedback gain changes according to the elapse of time after extraction starts. Especially, in the latter half of extraction, most of charged particles inside a RF bucket are already extracted; therefore, beam current amount is apt to be decreased. Consequently, when a feedback gain is increased, the control becomes effective. In Embodiment 7, a gain which is used in the frequency change ratio correction value computing unit 16 is read from a gain set value memory 325 which stores gains in time series after extraction starts, by changing a gain according to a time zone after extraction starts, a feedback control can be performed more effectively.

Embodiment 8

Figure 11:
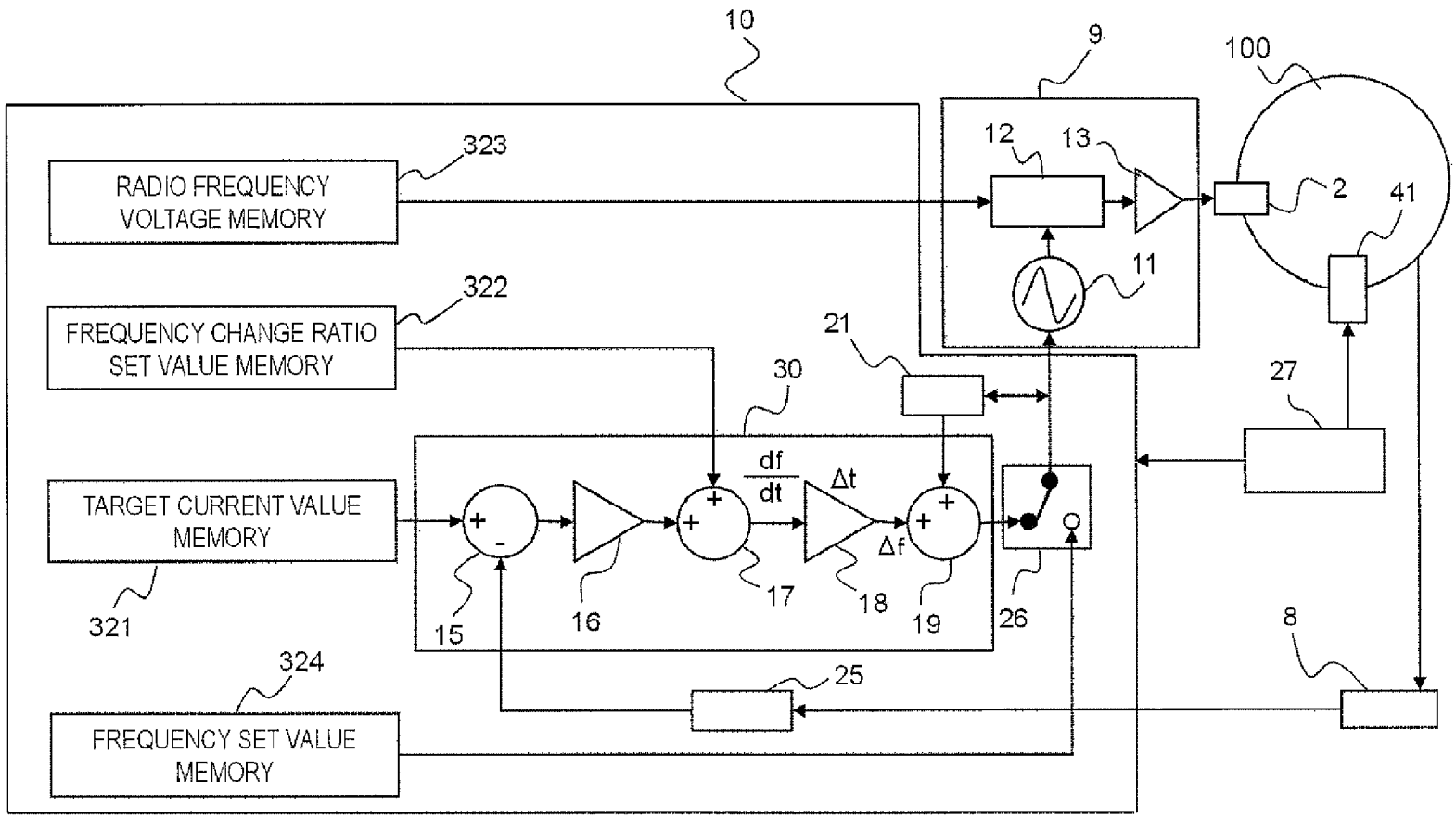
FIG. 11 is a block diagram illustrating a configuration of a radio-frequency control device in details which is an essential part of a circular accelerator according to Embodiment 8 of the present invention.

FIG. 11 is a block diagram illustrating a configuration of a radio-frequency control device in details which is an essential part of a circular accelerator according to Embodiment 8 of the present invention. In FIG. 11, the sign which is the same as that in FIG. 1 shows a same part or a corresponding part. In Embodiment 8, a high-speed quadruple magnet 41 is provided in a circular accelerator 100. In scanning irradiation, a position to be irradiated in a depth direction is determined by energy of a charged particle, by extracting charged particles having different energy, positions of different depth directions are irradiated. That is, by changing energy, an irradiation range which is determined by every depth is irradiated (which is called as slice. However, in a precise sense, even if an irradiation is performed with single energy, a depth of irradiation is not completely same, and depends on ununiformity in a body, or a size of body). Energy to be extracted is determined by acceleration of a circular accelerator, therefore, in acceleration which is performed by one extraction, extraction can be performed by single energy (same spill). On the other hand, in an irradiation object, there is a case in which extraction should be temporarily stopped, for example, a case where a vital organ should be avoided, a case where spots to be irradiated are separated, and a case where irradiation is performed in matching with the motion within a body (for example, respiratory gated irradiation). In order to stop extraction, there is a method in which a feedback control is stopped by a timing signal, and a direction of changing of frequency is rapidly reversed so as to stop extraction. That is, in a case where extraction is performed by decreasing a frequency, a frequency is increased. In a case where extraction is performed by increasing a frequency, a frequency is decreased. After extraction is started again by a timing signal, the feedback control is started again. However, according to the above-mentioned method, there is a case in which a feedback control becomes unstable because a frequency is changed for stopping. Then, in Embodiment 8, by continuing to read out a value of a frequency memory 21, without changing a frequency, the high-speed quadruple magnet 41 having small inductance and which responds with highspeed is excited so as to temporarily stop extraction. In this case, it is required only to continue to read out a value of frequency memory 21 so as to hold a value of frequency, therefore, control becomes easy. When a temporary stop of extraction and re-extraction can be performed by using the above-mentioned method, utilization efficiency of beam in a synchrotron which is accelerated by one extraction is increased, therefore, irradiation time can be shortened.

Further, in a scanning irradiation, in general, a beam is scanned in two dimensions by two bipolar magnets of irradiation system and the beam is scanned in the depth direction further by adjusting the energy so as to irradiate a target site. In this case, required irradiation amount is different per irradiation site. A method of adjusting current according to this invention can be applied to any energy of beam, per spill of different energy (time waveform of beam current which is extracted by one incidence, acceleration and extraction is called as spill), by changing a target current value which is transmitted to a current comparator 15, a beam current having the appropriate strength can be extracted. Further, within an irradiation area which is determined by each depth, that is, in a spill with same energy, required irradiation amount is different per position depending on a shape of edge part or a shape of whole of irradiation site. In this case, by changing a target current which is transmitted to the current comparator 15 in time series in the same spill, beam current strength can be changed with single energy.

When beam current strength can be changed, irradiation can be applied with large strength to a position where a scheduled amount of irradiation is large, and irradiation can be applied with small strength to a position where a scheduled amount of irradiation is small. Consequently, dose control is easy and irradiation time can be shortened. Further, as described in Embodiment 2, by adjusting a timing from a feed-forward control to a feedback control, or a feedback gain of a frequency change ratio corrector 17, beam current change according to schedule, without spike, can be realized.

What is claimed is:

1. A circular accelerator comprising:

a bending magnet which makes charged particles circulate along a circulating orbit so as to form a charged particle beam;

a radio-frequency cavity for accelerating the charged particles;

a radio-frequency generator including an output connected to the radio-frequency cavity and outputting a radio-frequency into the radio-frequency cavity, via the output connected thereto, for generating an electric field for accelerating the charged particles;

a radio-frequency control device which controls a radio-frequency which is generated by the radio-frequency generator;

a region division device which divides betatron oscillation of charged particles which circulate along the circulating orbit into a stable region and a resonance region;

an extracting device for extracting the charged particles from the circulating orbit; and a beam current detector which detects a beam current of the charged particles which are extracted from the extracting device;

wherein the charged particles are extracted from the extracting device by changing the frequency of the radio-frequency generated by the radio-frequency generator so as to narrow the stable region, wherein the radio-frequency control device comprises a target current memory which stores a target current value of the beam current of charged particles which are extracted from the extracting device and a frequency determination part in which a frequency change ratio is obtained by performing a feedback control based on an error signal between a detection signal of the beam current detector and the target current value which is stored in the target current value memory and then a subsequent frequency is determined from the obtained frequency change ratio and a current frequency, and wherein a subsequent frequency, which is determined by the frequency determination part, is stored in a frequency memory part so as for the radio-frequency generator to generate the subsequent frequency which is determined.

2. The circular accelerator according to claim 1, further comprising a frequency change ratio set value memory which stores a frequency change ratio as a time series data, which is a ratio of changing a frequency of a radio-frequency which is generated by the radio-frequency generator so as for the extracting device to extract the charged particles of the target current value, wherein the frequency determination part comprises:

a frequency change ratio correction value computing unit which performs a computing on an error signal between a detection signal of the beam current detector and the target current value which is stored in the target current value memory so as to determine a frequency change ratio correction value;

and a frequency change ratio corrector which corrects a frequency change ratio which is stored in the frequency change ratio set value memory by a frequency change ratio correction value which is determined by the frequency change ratio correction value computing unit so as to obtain a frequency change ratio.

3. The circular accelerator according to claim 1, wherein the radio-frequency controller comprises a frequency set value memory which stores a frequency which is determined in advance; and a changeover switch which changes a frequency which is determined by the frequency determination part and a frequency which is stored in the frequency set value memory, wherein the radio-frequency generator generates a frequency of radio-frequency which is switched by the changeover switch.

4. The circular accelerator according to claim 3, wherein the changeover switch switches a frequency which is stored in the frequency set value memory to a frequency which is determined by the frequency determination part, after a predetermined time from starting of extraction of the charged particle beam.

5. The circular accelerator according to claim 3, wherein the changeover switch switches a frequency which is stored in the frequency set value memory and a frequency which is determined by the frequency determination part, based on a detection signal of the beam current detector.

6. The circular accelerator according to claim 3, further comprising a remaining beam current monitor which detects a remaining beam current in the circular accelerator, wherein the changeover switch switches a frequency which is stored in the frequency set value memory and a frequency which is determined by the frequency determination part based on a detection signal of the remaining beam current monitor.

7. The circular accelerator according to claim 2, wherein a frequency change ratio which is corrected is stored in the frequency change ratio set value memory.

8. The circular accelerator according to claim 1, wherein the radio-frequency control device (i) obtains a voltage value of a radio-frequency, which is generated by the radio-frequency generator, based on a frequency change ratio which is obtained in the frequency determination part and a current frequency and (ii) transmits the obtained voltage value to the radio-frequency generator.

9. The circular accelerator according to claim 3, further comprising a frequency comparator which holds a final arrival frequency which is determined in advance, and transmits a signal to the changeover switch in a case where it is judged such that a frequency which is determined by the frequency controller reaches the final arrival frequency.

10. The circular accelerator according to claim 2, wherein the radio-frequency control device comprises a gain set value memory which stores gain values in time series after starting of extraction, which is determined in advance, and a gain of the frequency change ratio correction value computing unit is set by a gain value which is read from the gain set value memory.

11. A method of operating a circular accelerator comprising a bending magnet which makes charged particles circulate along a circulating orbit so as to form a charged particle beam;

a radio-frequency cavity for accelerating charged particles;

a radio-frequency generator including an output connected to the radio-frequency cavity and outputting a radio-frequency into the radio-frequency cavity, via the output connected thereto, for generating an electric field for accelerating the charged particles;

a region division device which divides betatron oscillation of the charged particles which circulate along the circulating orbit into a stable region and a resonance region;

an extracting device for extracting charged particles from the circulating orbit; and a beam current detector which detects a beam current of charged particles which are extracted from the extracting device, wherein the method comprises:

extracting, by the extracting device, the charged particles by changing the frequency of the radio-frequency generated by the radio-frequency generator so as to narrow the stable region, obtaining, by a frequency determination part, a frequency change ratio by performing a feedback control based on an error signal between a detection signal of the beam current detector and a target current value which is determined in advance, and determining a subsequent frequency, which is generated by the radio-frequency generator, from the obtained frequency change ratio and a current frequency, so as to operate the circular accelerator.

12. The method of operating a circular accelerator according to claim 11, wherein a frequency change ratio, which is determined in advance so as for the extracting device to extract the charged particles of the target current value, is corrected by performing a feedback control based on an error signal between a detection signal of the beam current detector and a target current value which is determined in advance, so as to obtain the frequency change ratio.

13. The method of operating a circular accelerator according to claim 12, wherein the obtained frequency change ratio is stored as a time series data from starting of extraction, and when a beam is extracted after another acceleration, the frequency change ratio which is determined in advance is replaced with the obtained frequency change ratio so as to operate the circular accelerator.

14. The method of operating a circular accelerator according to claim 11, wherein the target current value is changed in a time series data.

* * * * *